US006314674B1

(12) United States Patent
Lee

(10) Patent No.: US 6,314,674 B1
(45) Date of Patent: Nov. 13, 2001

(54) HANGING/STANDING SUPPORT STRUCTURE FOR PLANTS

(76) Inventor: Chung Ming Lee, 13 Endmoore Rd., Westford, MA (US) 01886

( * ) Notice: Subject to any disclaimer, the term of this patent is extended or adjusted under 35 U.S.C. 154(b) by 0 days.

(21) Appl. No.: 09/511,286

(22) Filed: Feb. 23, 2000

(51) Int. Cl.[7] ..... A47G 7/04; A47G 9/02
(52) U.S. Cl. ..... 47/39; 47/67; 47/904
(58) Field of Search ..... 47/39, 67, 904, 47/81; 220/489; 248/175, 318

(56) References Cited

U.S. PATENT DOCUMENTS

| | | | | |
|---|---|---|---|---|
| 33,774 | * | 11/1861 | Chamberlain | 47/67 |
| 353,131 | * | 11/1886 | Greenwood | 220/489 |
| 858,543 | * | 7/1907 | Sickmiller | 248/318 |
| 1,599,243 | * | 9/1926 | Parker | 220/489 |
| 1,624,504 | * | 4/1927 | Pfarr | 47/67 |
| 3,013,758 | * | 12/1961 | Smith | 248/153 |
| 4,506,475 | * | 3/1985 | Elliott | 47/67 |
| 5,267,664 | * | 12/1993 | Younikian | 220/6 |
| 5,454,191 | * | 10/1995 | Mayeda et al. | 47/65.8 |
| 6,027,083 | * | 2/2000 | Chang | 248/153 |
| 6,119,393 | * | 9/2000 | Wourns et al. | 47/39 |

FOREIGN PATENT DOCUMENTS

| | | | | |
|---|---|---|---|---|
| 688427 | * | 9/1997 | (CH) | A01G/27/04 |
| 9084464 | * | 3/1997 | (JP) | A01G/9/00 |

* cited by examiner

*Primary Examiner*—Peter M. Poon
*Assistant Examiner*—Son T. Nguyen
(74) *Attorney, Agent, or Firm*—Charles I. Brodsky

(57) ABSTRACT

A support structure for plants including a basket centered about a vertical axis, and a coconut fiber liner set within the basket to form a container for potting soil and plants placed therein, with the basket being arranged either to hang from an overhead position when being displayed, or to alternatively stand on the ground when the hanging of the basket is not desired.

10 Claims, 3 Drawing Sheets

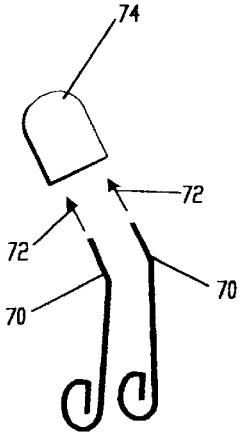
FIG.3a
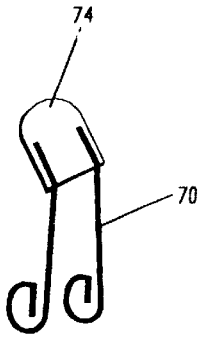
FIG.3b
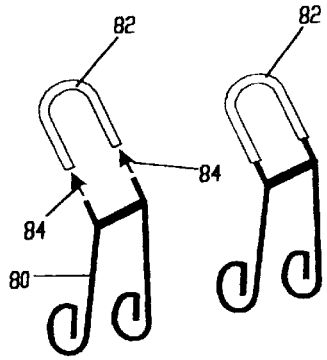
FIG.4a
FIG.4b
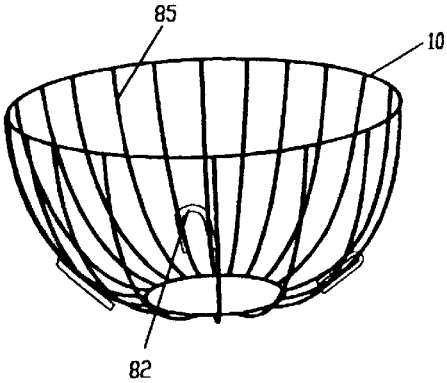
FIG.4c
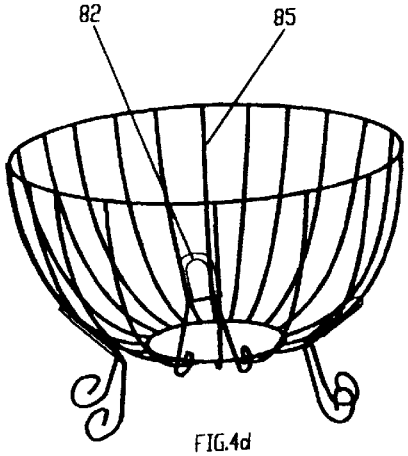
FIG.4d
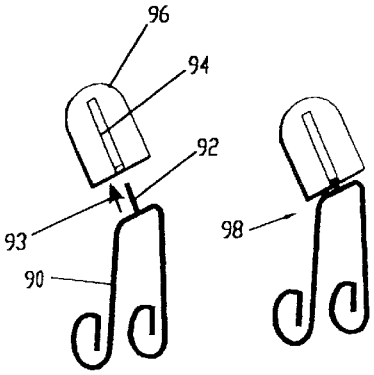
FIG.5a
FIG.5b
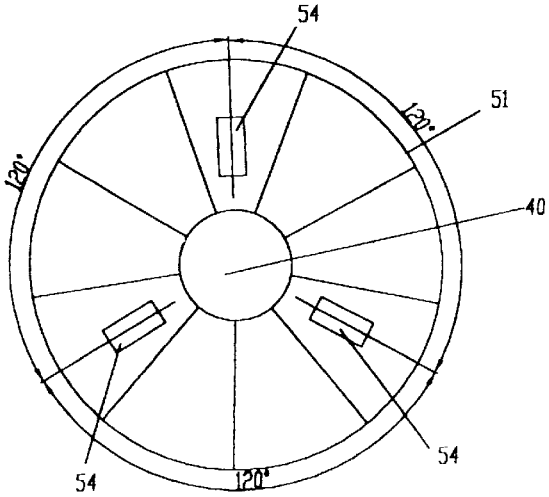
FIG. 6

HANGING/STANDING SUPPORT STRUCTURE FOR PLANTS

FIELD OF THE INVENTION

This invention relates to the displaying of plants, and, more particularly, to the displaying of plants by those not blessed with the talent of having a "green thumb".

BACKGROUND OF THE INVENTION

Plastic baskets for the hanging display of plants are well known. Equally known is the hanging of a wire basket in which the plant and potting soil are retained, within a coconut fiber liner set into the basket. As will be appreciated by users of such display baskets, the wire basket is in the form of a "cage" welded to the desired shape, and coated to provide a rust resistent surface. As is also understood, the coconut fiber liner is permeable to allow outside air to penetrate to the roots of the plant, while allowing excess water added to the potting soil to seep out.

As will become clear from the following description, the support structure of the present invention, allows for the plants to be displayed hanging from an overhead position, as well as standing on the ground.

SUMMARY OF THE INVENTION

Thus, the support structure according the invention includes two or more legs extending downwardly from an underside of the wire basket—and preferably includes three legs spaced at 120° intervals about the basket. In the preferred embodiment set out, such legs are detachably connected to sockets secured to the wire basket about its outside periphery, with the sockets being welded in position. When, for example, it is desired to hang the basket to display plants, the legs can be separated from the sockets and stored. On those occasions where it is desired to stand the basket on the ground for display, the legs can be inserted into the sockets—with the arrangement used to previously hang the basket then being removed.

As described, the support structure of the invention includes a bowl internal of the basket, and adjacent to its bottom, for receiving the coconut fiber liner placed within. To support the weight of the potting soil and the plant set into the liner, a cover is included for the bowl, apertured about its surface to allow excess water to pass into the bowl to be collected. In those circumstances where the potting soil might tend to dry, the bowl can also be provided, according to the invention, with a wick extending upwardly through an opening provided within the bottom of the coconut fiber liner, to allow collected water to be drawn up into the soil by capillary action. In such embodiment, and to allow a sufficient reservoir for collecting the water and for dispensing it through the wick, the bowl is selected of a diameter of the order of 5"–6".

As will be appreciated, with this arrangement as set forth, even a rank amateur would not have to worry about overwatering the plant, and would not have to worry about the plant not receiving enough water to grow healthily. At the same time, the opportunity is presented for displaying the basket support structure either as a "hanging cocobasket", or as a "standing cocobasket".

BRIEF DESCRIPTION OF THE DRAWINGS

These and other features of the present invention will be more clearly understood from a consideration of the following description, taken in connection with the accompanying drawings, in which:

FIGS. 3*a*–3*b*, 4*a*–4*d* and 5*a*–5*b* are views of alternative component parts for assembling the support structure according to the invention; and FIG. 6 is a bottom view of a support structure arranged pursuant to the teachings of the preferred embodiments.

DETAILED DESCRIPTION OF THE PREFERRED EMBODIMENTS

Figure 1A:
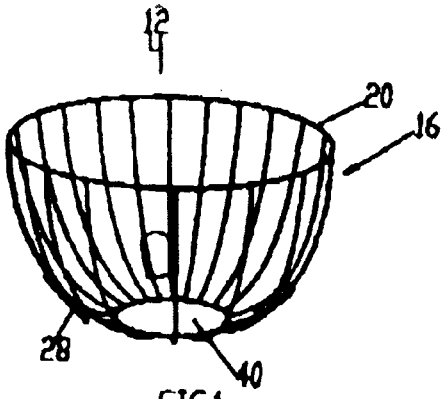
FIGS. 1*a*–1*f* are views of the component parts which together form a preferred support structure embodying the invention.
Figure 1C:
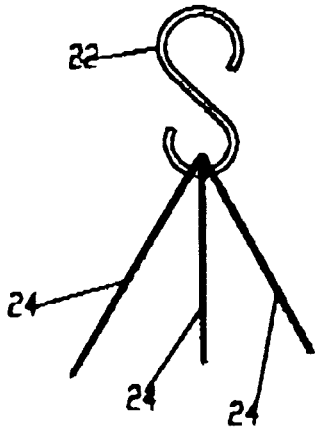
Figure 1B:
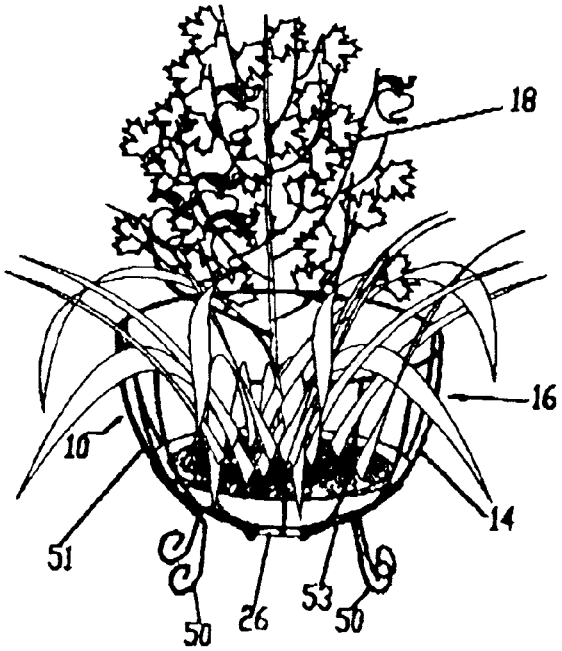
Figure 1D:
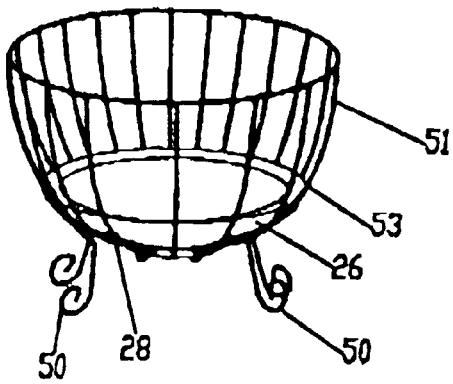
Figure 1F:
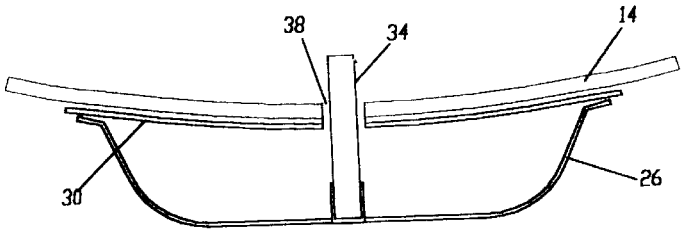
Figure 1E:
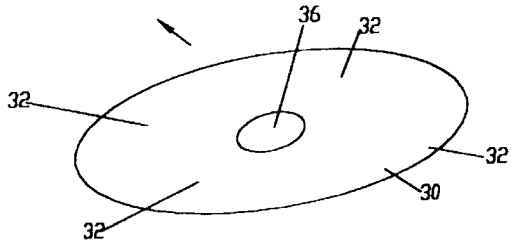

FIGS. 1*a*–1*f* illustrate the components parts which make up the support structure for the invention. A wire basket 10 is shown centered about a vertical axis 12 (FIG. 1*a*), to receive a coconut fiber liner 14 set within the basket to form a container for potting soil 16 and a plant 18 placed therein (FIG. 1*b*). Coupled to the wire basket 10, as along its upper rim 20, is a hook 22 and arm 24 arrangement available to hang the basket 10 from an overhead position (FIG. 1*c*). A bowl 26 fits within the basket 10, adjacent its bottom 28, to receive the coconut fiber liner 14 when placed within the bowl (FIG. 1*d*). A cover 30 for the bowl 26 (FIG. 1*e*) supports the weight of the potting soil 16 and the plant 18, and is apertured about its surface, as at 32. A wick 34 (FIG. 1*f*) extends upwardly from the reservoir of the bowl 26 through a central aperture 36 in the cover 30 and through an aperture 38 in the liner 14 centered about a central opening 40 in the wire basket 10.

In this manner, the wire basket 10 could be suspended from overhead by the hook 22, water could be added to the potting soil 16, excess water could collect in the bowl 26, and when the soil dries, capillary action replenishes the water in the soil by means of the wick 34.

Although shown of hemispherical shape in FIGS. 1*a*–1*f*, the basket 10 can be in any form of cage, welded (for example) to the desired shape—and where appropriate, coated to provide rust resistance. The coconut fiber liner is selected to be permeable while continuing to allow excessive water to seep outwardly.

FIGS. 1*b* and 1*d* also illustrate a pair of leg configurations 50 for the alternate standing of the wire basket 10 on the ground, when a hanging of the basket 10 is undesired. Two or more such leg configurations 50 are included according to the invention—with three such leg configurations 50 being preferable, spaced 120° apart about the periphery 51 on the outside of the basket (FIG. 6). As will be appreciated, such leg configurations extend downwardly from the underside 53 of the basket 10.

Figure 2A:
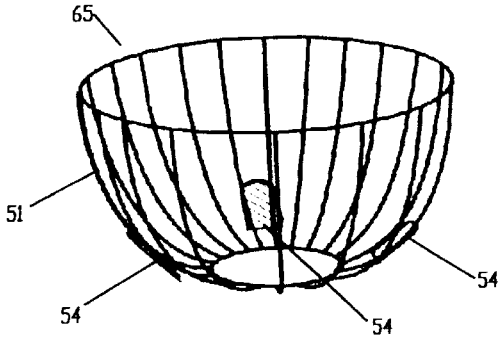
FIGS. 2*a*–2*d* are views of component parts helpful in an understanding of a second embodiment of the invention.
Figure 2B:
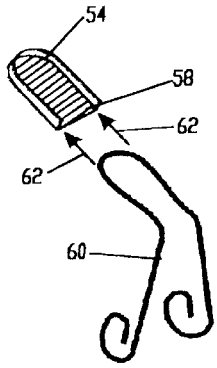
Figure 2C:
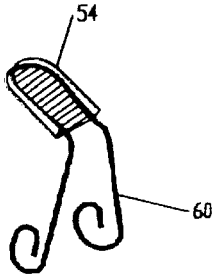
Figure 2D:
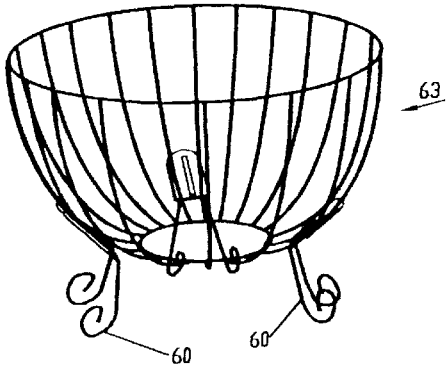

As will be readily appreciated by those skilled in the art, different methods may be utilized to couple such leg configurations 50 to the basket 10. In FIG. 2*a*, sockets 54 may be secured to the basket 10 about the periphery 51, to receive a detachable leg (FIG. 2*b*). The socket 54 is provided with a channel opening 58 to accept a compressible spring-type leg 60 inserted in the direction of the arrows 62, as in FIG. 2*c*. The standing-basket configuration 63 of FIG. 2*d* results when the leg 60 is inserted into the socket 54, while FIG. 2*a* shows the configuration 65 without the legs. The coconut fiber liner 14 and the bowl 26 inserted into the configuration 63 then gives the overall appearance of the support structure of FIG. 1*b*.

FIGS. 3*a* and 3*b* show an alternative leg configuration for standing the basket on the ground, in which individual legs

70 are inserted in the direction of the arrows 72 into channel openings of a tab 74. With the tab 74 fitted into the socket 54 the appearance of FIG. 1*d* results.

FIGS. 4*a* and 4*b* illustrate another leg configuration, with the legs 80 inserted into the shape of a compressible tab 82 in the direction of the arrows 84. With such compressible tab 82, the welded sockets 54 of FIG. 2*a* could be removed, and the compressible tabs 82 are themselves fitted between the individual ribs 85 of the wire basket 10 (FIG. 4*c*). When released, the tabs 82 are held in place by the resilient fit between the ribs 85 and the tabs 82 (FIG. 4*d*).

FIGS. 5*a* and 5*b* illustrate a further leg configuration for the sockets 54 of FIG. 2*a*, with the legs 90 of FIG. 5*a* having an extension 92 to fit via the arrow 93 in a channel 94 of the tab 96 in forming the coupled appearance 98 (FIG. 5*b*).

As will be appreciated, the hanging basket arrangement with FIG. 1*c* can continue no matter which of the various leg configurations are utilized—or others equally as well—whether employed with welded sockets, or compressible tabs. When a standing support display is desired only, the hook 22 and arm arrangement 24 can be detached from the rim 20 of the basket 10 and then stored away, with the appropriate standing display then used. As will be recognized, in any of these arrangements, however, the bowl for collecting the excess water, its cover to support the weight of the potting soil and the plant, and the coconut fiber liner (permeable to air and to water) will continue as inserted.

While there have been described what are considered to be preferred embodiments of the present invention, it will be readily understood by those skilled in the art that modifications can be made without departing from the scope of the teachings herein. For example, whereas the invention has been described in the context of a wire basket, it will be appreciated that its teachings of being either a hanging or standing support structure for plants applies equally as well with a plastic or other material basket, with plastic or other material legs—albeit perhaps with a lesser degree of stability. For at least such reason, therefore, resort should be had to the claims appended hereto for a true understanding of the scope of the invention.

I claim:

1. A support structure for plants comprising:

a basket centered about a vertical axis;

a coconut fiber liner set within said basket forming a container for potting soil and a plant placed therein;

means coupled to said basket for the hanging of said basket from an overhead position;

means coupled to said basket for the alternate standing of said basket on the ground, when a hanging of said basket is undesired;

a bowl internal of said basket and adjacent a bottom thereof, for receiving said coconut fiber liner when set within said basket;

a cover for said bowl including a plurality of apertures about the surface thereof and a further central aperture;

an opening within a bottom of said coconut fiber liner;

and a wick extending upwardly from a bottom of said bowl through said central aperture and said liner opening;

wherein said alternate standing means includes two or more legs extending downwardly from an underside of said basket;

and wherein said legs detachably connect to sockets secured to said basket about an outside periphery thereof.

2. The support structure of claim 1 wherein said alternate standing means includes three legs spaced 120° apart along said underside of said basket.

3. The support structure of claim 1 wherein said bowl is of a diameter of the order of 5"–6".

4. The support structure of claim 1 wherein said basket is of a wire material.

5. The support structure of claim 4 wherein said basket is of a wire material coated to provide rust resistance.

6. The support structure of claim 1 wherein said cover is of a construction to support the weight of potting soil and plant placed within said liner.

7. The support structure of claim 1 wherein said detachably connecting legs are of a plastic fabrication.

8. The support structure of claim 1 wherein said wick extends upwardly from within a slot at said bottom of said bowl.

9. The support structure of claim 8 wherein said wick is of a diameter to snugly fit within upwardly extending walls of said slot.

10. The support structure of claim 9 wherein said bowl is of a plastic fabrication.

* * * * *